US010000083B2

(12) United States Patent
Ogino et al.

(10) Patent No.: US 10,000,083 B2
(45) Date of Patent: Jun. 19, 2018

(54) THERMOSENSITIVE RECORDING MEDIUM

(71) Applicant: Nippon Paper Industries Co., Ltd., Tokyo (JP)

(72) Inventors: Akihito Ogino, Tokyo (JP); Kenji Hirai, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days. days.

(21) Appl. No.: 15/318,813

(22) PCT Filed: May 26, 2015

(86) PCT No.: PCT/JP2015/065054

§ 371 (c)(1),
(2) Date: Dec. 14, 2016

(87) PCT Pub. No.: WO2015/194329

PCT Pub. Date: Dec. 23, 2015

(65) Prior Publication Data

US 2017/0129266 A1 May 11, 2017

(30) Foreign Application Priority Data

Jun. 16, 2014 (JP) ..... 2014-123077
Jun. 16, 2014 (JP) ..... 2014-123078

(51) Int. Cl.

| | |
|---|---|
| ***B41M 5/333*** | (2006.01) |
| ***B41M 5/337*** | (2006.01) |
| ***B41M 5/44*** | (2006.01) |
| ***B41M 5/323*** | (2006.01) |

(52) U.S. Cl.

CPC ..... *B41M 5/3336* (2013.01); *B41M 5/323* (2013.01); *B41M 5/3372* (2013.01); *B41M 5/44* (2013.01); *B41M 2205/04* (2013.01); *B41M 2205/40* (2013.01)

(58) Field of Classification Search

CPC .... B41M 5/323; B41M 5/333; B41M 5/3333; B41M 5/3335; B41M 5/3336; B41M 5/3372; B41M 2205/04; B41M 2205/40

USPC ..... 503/216

See application file for complete search history.

(56) References Cited

U.S. PATENT DOCUMENTS

| | | | |
|---|---|---|---|
| 8,129,307 | B2 | 3/2012 | Makihara et al. |
| 8,247,347 | B2 | 8/2012 | Takagi et al. |
| 8,283,284 | B2 | 10/2012 | Hirai et al. |
| 8,466,085 | B2 | 6/2013 | Kato et al. |
| 8,492,308 | B2 | 7/2013 | Kurihara et al. |
| 8,609,582 | B2 | 12/2013 | Hirai et al. |
| 8,722,576 | B2 | 5/2014 | Hayakawa et al. |
| 2005/0148467 | A1 | 7/2005 | Makitalo et al. |
| 2009/0169282 | A1 | 7/2009 | Keeton |
| 2011/0269622 | A1 | 11/2011 | Ohse et al. |
| 2012/0208698 | A1 | 8/2012 | Hayakawa et al. |
| 2016/0236497 | A1 | 8/2016 | Matsumori et al. |

FOREIGN PATENT DOCUMENTS

| | | | |
|---|---|---|---|
| EP | 0 526 072 | A1 | 2/1993 |
| EP | 1 116 713 | A1 | 7/2001 |
| EP | 1 243 437 | A1 | 9/2002 |
| EP | 2 033 799 | A1 | 3/2009 |
| JP | 53-091995 | | 8/1978 |
| JP | 1-130972 | | 5/1989 |
| JP | H07-149713 | | 6/1995 |
| JP | H07-223374 | | 8/1995 |
| JP | H08-059603 | | 3/1996 |
| JP | H08-230324 | | 9/1996 |
| JP | H09-164763 | | 6/1997 |
| JP | H10-258577 | | 9/1998 |
| JP | 2000-198271 | A1 | 7/2000 |
| JP | 2001-092358 | | 4/2001 |
| JP | 2002-160462 | A | 6/2002 |
| JP | 2002-301873 | A | 10/2002 |
| JP | 2003-154760 | A | 5/2003 |
| JP | 2003-291542 | A | 10/2003 |
| JP | 2005-335295 | | 12/2005 |
| JP | 2005-343907 | | 12/2005 |
| JP | 2006-198781 | A | 8/2006 |
| JP | 2004-322617 | A | 11/2006 |
| JP | 2007-030371 | A | 2/2007 |

(Continued)

OTHER PUBLICATIONS

Communication of the European Search Report corresponding to European Application No. 15810553.6 dated Jul. 21, 2017.

International Search Report corresponding to the International Application No. PCT/JP2015/065054 dated Jun. 23, 2015.

Supplementary European Search Report corresponding to European Patent Application No. 15810553.6 / 3141397 dated Jul. 21, 2017.

International Preliminary Report on Patentability corresponding to International Patent Application No. PCT/JP2015/065054 dated Dec. 29, 2016.

International Search Report corresponding to International Patent Application No. PCT/JP2010/064862 dated Sep. 28, 2010.

(Continued)

*Primary Examiner* — Bruce H Hess

(74) *Attorney, Agent, or Firm* — Jenkins, Wilson, Taylor & Hunt, P.A.

(57) ABSTRACT

A thermosensitive recording medium is provided that is excellent in heat discoloration resistance in the blank portions and in bar code readability. It also has excellent water resistance and printing (recording) run-ability. The thermosensitive recording medium includes a support, a thermosensitive recording layer installed on the support, and a protective layer on the thermosensitive recording layer. The thermosensitive recording layer contains two kinds of electron accepting color developing agents, a sulfonic acid compound and a diphenyl sulfone compound. Both the thermosensitive recording layer and the protective layer contain crosslinking agents, and at least one, and preferably both, of the thermosensitive recording layer and the protective layer contain an ammonium zirconium carbonate as the crosslinking agent.

14 Claims, No Drawings

(56) References Cited

FOREIGN PATENT DOCUMENTS

| | | | |
|---|---|---|---|
| JP | 2007-245362 | | 9/2007 |
| JP | 2008-194912 | | 8/2008 |
| JP | 2009-137220 | | 6/2009 |
| JP | 2013-018269 | A | 1/2013 |
| WO | WO1993/006074 | | 4/1993 |
| WO | WO1995/033714 | | 12/1995 |
| WO | WO 97/16420 | A1 | 5/1997 |
| WO | WO 02/081229 | A1 | 10/2002 |
| WO | WO2002/081229 | | 10/2002 |
| WO | WO 2006/075467 | A1 | 7/2006 |
| WO | WO 2008/099658 | | 8/2008 |
| WO | WO 2008/126635 | | 10/2008 |
| WO | WO 2008/139948 | | 11/2008 |
| WO | WO 2009/025316 | | 2/2009 |
| WO | WO 2009/028118 | | 3/2009 |
| WO | WO 2009/119813 | | 10/2009 |
| WO | WO 2010/110209 | A1 | 9/2010 |
| WO | WO 2011/027752 | | 3/2011 |
| WO | WO 2015/046305 | A1 | 4/2015 |

OTHER PUBLICATIONS

Japanese Industrial Standard JIS Z 0237 "Tesing methods of pressure-sensitive adhesive tapes and sheets," Japanese Standards Association (38 pages) (2009).

Notice of Allowance corresponding to U.S. Appl. No. 13/393,827 dated Feb. 4, 2014.

Notification of Transmittal of Translation of the International Preliminary Report on Patentability (Chapter I or Chapter II of the Patent Cooperation Treaty) corresponding to International Patent Application No. PCT/JP2010/064862 dated Mar. 29, 2012.

Official Action corresponding to U.S. Appl. No. 13/393,827 dated Sep. 17, 2013.

Supplementary European Search Report corresponding to European Patent Application No. 10813701.9-1701 / 2474963 dated Feb. 12, 2013.

THERMOSENSITIVE RECORDING MEDIUM

RELATED APPLICATIONS

The application is the U.S. National Stage of PCT International Application No. PCT/JP2015/065054, filed on May 26, 2015, which claims priority to Japanese Patent Application No. 2014-123077, filed on Jun. 16, 2014 and Japanese Patent Application No. 2014-123078, filed on Jun. 16, 2014.

FIELD OF THE INVENTION

The present invention relates to a thermosensitive recording medium for recording image by utilizing a coloring reaction between a colorless or pale colored electron donating leuco dye (referred to as "leuco dye") and an electron accepting color developing agent (referred to as "color developing agent"), which is excellent in heat discoloration resistance in the blank portions and bar code readability, and is excellent further in water resistance and printing (recording) run-ability.

BACKGROUND OF THE INVENTION

Thermosensitive recording media are ordinarily prepared by mixing together a leuco dye and a color developing agent, such as a phenolic compound and the like, after grinding them into fine particles, preparing a coating solution by adding a binder, a filler, a sensitizer, a slipping agent and other aids to the mixture and applying the coating solution onto a substrate such as paper, synthetic paper, film, plastic and the like. Thermosensitive recording medium develops color through an instantaneous chemical reaction when heated by a thermal head, hot stamp, hot pen, laser light or the like to yield a recorded image. Such thermosensitive recording media are used extensively in recording media such as facsimile devices, computer terminal printers, automatic ticket dispensers, recorders for meters, receipts at super markets and convenience stores and the like.

In recent years, the medium is becoming smaller in such an application as handy terminal application, then the medium is required to have a more superior color developing property. For example, the medium is required to have a better color developing sensitivity and image quality, especially bar code readability in such an application as labels and tickets. In addition, the medium is required to be superior in preserving property, such as water resistance, plasticizer resistance and the like, which have not been problematic for a conventional thermosensitive recording media. For example, since the medium is often used in outdoor label application or in food application, the medium is required to have a superior readability of the image which is easily deteriorated by water or moisture of rain drops. Furthermore, since tickets are often accommodated in wallet, the medium for tickets is required to have a superior readability of the image which is easily deteriorated by the plasticizers that is often contained in the synthetic leather used for wallets.

As a method of improving the storage stability of image area, it is generally known to install a protective layer on the thermosensitive recording layer. However, when a protective layer is formed on the thermal recording layer, the protective layer absorbs the heat energy from a thermal head or the like, thereby the color developing performance, i.e. color developing sensitivity and image quality, becomes poorer. In particular, as the contrast between the printed area and a blank area is lowered due to the reduced color developing sensitivity, for example, when a bar code is printed on the medium, the printed barcode cannot be read properly by a reading machine, i.e. the bar code readability becomes poor.

On the other hand, it has been implemented to improve the storage stability of the image portion by incorporating two types of color developing agents, a specific sulfonic acid compound and a specific diphenyl sulfone compound, in the thermosensitive recording layer (References 1 to 3 etc.).

Furthermore, it is also implemented to improve the water resistance and the like of the thermosensitive recording medium by using a specific binder and a specific crosslinking agent in a thermosensitive recording layer and a protective layer (References 4 to 6 etc.).

REFERENCES

Reference 1: Japanese Patent Application Public Disclosure 2007-30371

Reference 2: Japanese Patent Application Public Disclosure 2002-160462

Reference 3: Japanese Patent Application Public Disclosure 2003-291542

Reference 4: Japanese Patent Application Public Disclosure 2000-198271

Reference 5: International Publication WO2006/075467

Reference 6: International Publication WO2010/110209

PROBLEMS TO BE SOLVED BY THE INVENTION

In recent years, in such an application as handy terminal for tickets, the thermosensitive recording medium has been required to be excellent in heat discoloration resistance in the blank portions and bar code readability, and also in water resistance and printing (recording) run-ability.

However, according to the study by the inventors, although the heat discoloration resistance in the blank portions and the bar code readability could be improved by incorporating two types of color developing agents, a specific sulfonic acid compound and a specific diphenyl sulfone compound, in the thermosensitive recording layer (References 1 to 3 etc), the water resistance and the printing (recording) run-ability were found to be deteriorated by the use of these color developing agents (see Comparative Examples 1, 4, 11, 13, etc.).

Accordingly, the objective of the present invention is to provide a thermosensitive recording medium, which is excellent in heat discoloration resistance in the blank portions and bar code readability, and is excellent also in water resistance and printing (recording) run-ability.

MEANS TO SOLVE THE PROBLEMS

In order to solve the above problems, the present inventors studied the effects of incorporating a crosslinking agent in a thermosensitive recording layer and a protective layer, in the configuration comprising a thermosensitive recording layer and a protective layer installed in this order on a support, in which the thermosensitive recording layer comprises two types of color developing agents, a specific sulfonic acid compound and a specific diphenyl sulfone compound. As a result, the present inventors found that the above problems can be solves by incorporating a specific crosslinking agent in the thermosensitive recording layer and the protective layer and then completed the present invention.

That is, the present invention provides a thermosensitive recording medium comprising a support, a thermosensitive recording layer installed on the support, comprising a colorless or pale colored electron donating leuco dye and an electron accepting color developing agent, and a protective layer on the thermosensitive recording layer, wherein the thermosensitive recording layer comprises, as the electron accepting color developing agent, (i) a sulfonic acid compound represented by the following formula (formula 1)

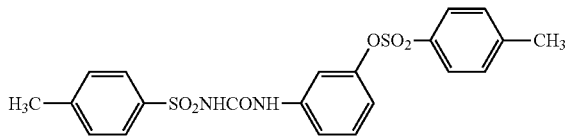

and (ii) a diphenyl sulfone compound represented by the following formula (formula 2)

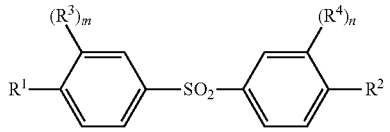

wherein $R^1$ represents a hydroxyl group or a group represented by the following formula (formula 3),

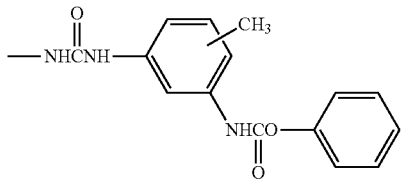

$R^2$ represents —$OR^5$ (wherein $R^5$ represents a linear or branched, saturated or unsaturated hydrocarbon having 1 to 4 carbons) or a group represented by the above formula 3, $R^3$ and $R^4$ each independently represent an alkyl group or an alkenyl group, and m and n each independently represent 0 or 1, wherein both of the thermosensitive recording layer and the protective layer respectively comprise crosslinking agents, and at least one of the thermosensitive recording layer and the protective layer comprises an ammonium zirconium carbonate as the crosslinking agent.

DETAILED DESCRIPTION OF THE INVENTION

The thermosensitive recording medium of the present invention comprises a support, a thermosensitive recording layer installed on the support, and a protective layer on the thermosensitive recording layer.

The thermosensitive recording layer of the present invention comprises, as the color developing agent, (i) a sulfonic acid compound represented by the following formula (formula 1)

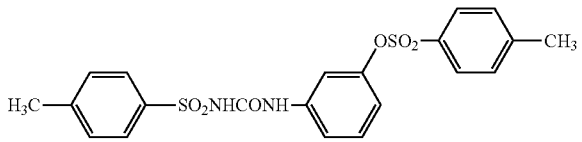

and (ii) a diphenyl sulfone compound represented by the following formula (formula 2).

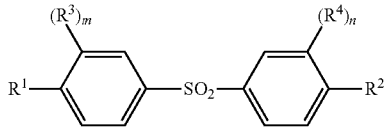

When the thermosensitive recording layer of the present invention comprises, as the color developing agent, the sulfonic acid compound represented by the following formula (formula 1) and the diphenyl sulfone compound represented by the following formula (formula 2), the resulted thermosensitive recording medium could be excellent in color developing property and heat discoloration resistance in the blank portions, and is also good in bar code readability.

In the above formula (formula 2), $R^1$ represents a hydroxyl group or a group represented by the following formula (formula 3).

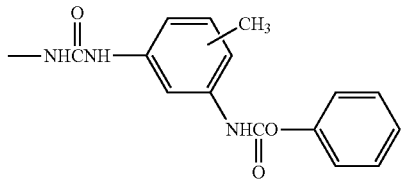

$R^2$ represents —$OR^5$ or a group represented by the above formula 3.

$R^5$ represents a hydrocarbon having 1 to 4 carbons, which may be saturated or unsaturated, which may be linear or branched. Such a saturated hydrocarbon group includes, for example, methyl, ethyl, n-propyl, isopropyl, n-butyl, t-butyl, isoamyl and the like. Such an unsaturated hydrocarbon includes, for example, ethenyl (i.e. vinyl), 1-n-propenyl, 2-n-propenyl (i.e. allyl), isopropenyl, 1-n-butene, 2-n-butene, 3-n-butene (i.e. butenyl) and the like. Among these, $R^5$ is preferably methyl, ethyl, vinyl, allyl, or butenyl, more preferably allyl.

$R^3$ and $R^4$ each independently represent an alkyl group or an alkenyl group. The number of carbons of the alkyl group and the alkenyl group is each independently preferably 1 to 4, more preferably 3. The alkenyl group, for example, includes vinyl, allyl, and butenyl. Among these, $R^3$ and $R^4$ are preferably allyl.

m and n each independently represent 0 or 1, preferably 0.

The diphenyl sulfone compound of the present invention is preferably the diphenyl sulfone compound represented by the following formula (formula 4), wherein $R^3$ to $R^5$, m and n are as defined above, or

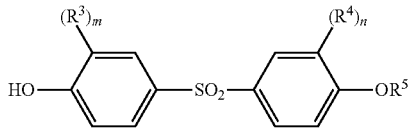

the urea-urethane type diphenyl sulfone compound represented by the following formula (formula 5).

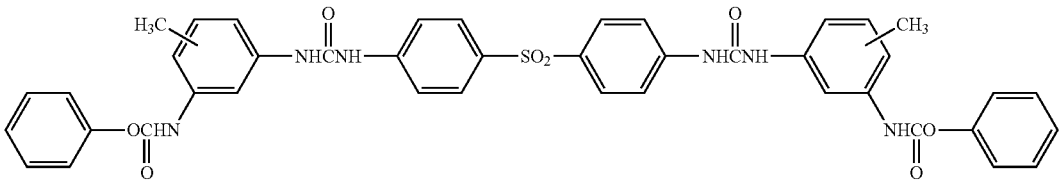

As the specific examples of the diphenyl sulfone compound represented by the above formula (formula 4), 4-hydroxy-4'-isopropoxy diphenyl sulfone, 4-hydroxy-4'-n-propoxy diphenyl sulfone, 4-hydroxy-4'-allyloxy diphenyl sulfone, 4-hydroxy-4'-ethoxy diphenyl sulfone, 4-hydroxy-4'-n-butoxy diphenyl sulfone, and the like, may be cited. The diphenyl sulfone compound is preferably 4-hydroxy-4'-isopropoxy diphenyl sulfone, 4-hydroxy-4'-n-propoxy diphenyl sulfone, 4-hydroxy-4'-allyloxy diphenyl sulfone, 4-hydroxy-4'-ethoxy diphenyl sulfone, or 4-hydroxy-4'-n-butoxy diphenyl sulfone. Among these, the diphenyl sulfone compound is more preferably 4-hydroxy-4'-allyloxy diphenyl sulfone, which is available as BPS-MAE (trade name) produced by Nicca Chemical Co., Ltd. and the like.

The urea-urethane type diphenyl sulfone compound includes specifically three kinds of compounds represented by the following formulas, formula 6 to formula 8. These may be used individually or as a mixture of at least two of them.

Formula 6

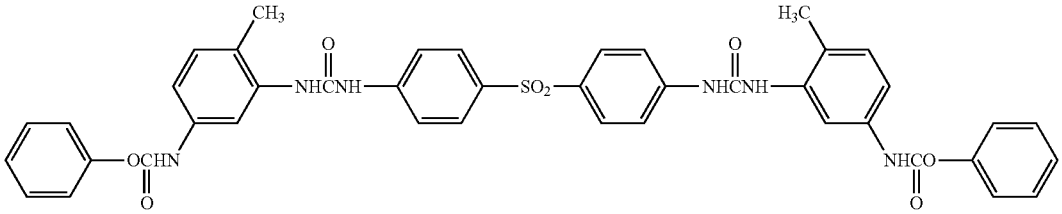

Formula 7

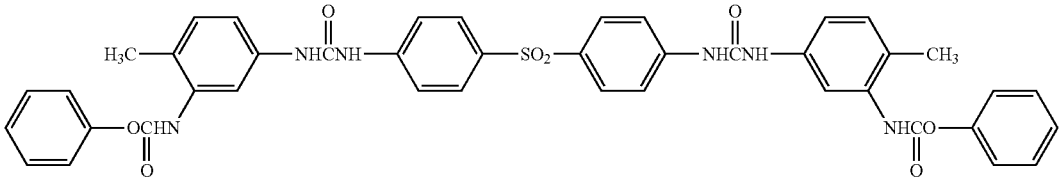

Formula 8

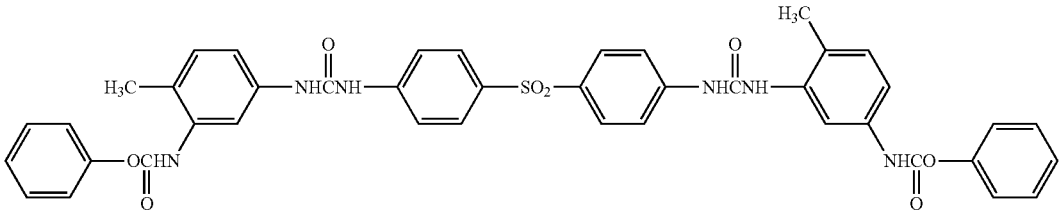

The color developing agents other than the above mentioned color developing agents may be used in combination with the above mentioned color developing agents. As the color developing agents, for example, activated clay, attapulgite, colloidal silica, inorganic acidic substances such as aluminum silicate and the like, 4,4'-isopropylidene diphenol, 1,1-bis(4-hydroxyphenyl) cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, bis(3-allyl-4-hydroxyphenyl) sulfone, 4-hydroxyphenyl-4'-benzyloxyphenyl sulfone, 3,4-dihydroxyphenyl-4'-methyl phenyl sulfone, 1-[4-(4-hydroxyphenyl-sulfonyl) phenoxy]-4-[4-(4-isopropoxyphenyl sulfonyl) phenoxy] butane, phenol condensate composition described in Japanese Patent Application Public Disclosure No. 2003-154760, aminobenzene sulfonamide derivatives described in Japanese Patent Application Public Disclosure No. H08-59603, bis(4-hydroxyphenyl thioethoxy) methane, 1,5-di(4-hydroxyphenyl thio)-3-oxapentane, butyl bis(p-hydroxyphenyl) acetate, methyl bis(p-hydroxyphenyl) acetate, 1,1-bis(4-hydroxyphenyl)-1-phenyl ethane, 1,4-bis[α-methyl-α-(4'-hydroxyphenyl) ethyl]benzene, 1,3-bis[α-methyl-α-(4'-hydroxyphenyl) ethyl] benzene, di(4-hydroxy-3-methylphenyl) sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino salicylate]dihydrate, 4-[2-(p-methoxyphenoxy) ethyloxy] salicylic acid, 4-[3-(p-tolylsulfonyl) propyloxy] salicylic acid, aromatic carboxylic acids such as 5-[p-(2-p-methoxyphenoxyethoxy)cumyl] salicylic acid, and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts of terephthal aldehyde acid with other aromatic carboxylic acids and the like may be cited.

These color developing agents may be used individually or as a mixture of at least two of them.

1-[4-(4-hydroxyphenyl-sulfonyl)phenoxy]-4-[4-(4-isopropoxyphenyl sulfonyl) phenoxy]butane is available, for example, under the trade name of JKY-214 produced by API Corporation. The phenol condensate composition described in Japanese Patent Application Public Disclosure No. 2003-154760 is available, for example, under the trade name of JKY-224 produced by API Corporation. The diphenylsulfone crosslinked type compound described in International Publication WO97/16420 is available, for example, under the trade name of D-90 produced by Nippon Soda Co., Ltd. The compound described in International Publication WO02/081229 is available, for example, under the trade names of NKK-395 and D-100 produced by Nippon Soda Co., Ltd. In addition, high molecular weight aliphatic acid metal complex salts described in Japanese Patent Application Public Disclosure No. H10-258577 and metal chelate type color developing components such as polyvalent hydroxy aromatic compounds and the like may also be present.

In the present invention, the amount of the diphenyl sulfone compound represented by the above formula 2 is preferably from 0.01 to 10.0 weight parts, more preferably from 0.1 to 5.0 weight parts per 1 weight part of the sulfonic acid compound represented by the above formula 1. When the amount of the diphenyl sulfone compound represented by the above formula 2 is less than 0.01 weight parts per 1 weight part of the sulfonic acid compound represented by the above formula 1, the color developing property of the thermo-sensitive recording medium tends to be deteriorated. On the other hand, when the amount of the diphenyl sulfone compound represented by the above formula 2 is more than 10.0 weight parts, the heat discoloration resistance in the blank portions tends to be insufficient.

The combined amount of the sulfonic acid compound represented by the above formula 1 and the diphenyl sulfone compound represented by the above formula 2 is preferably 50 weight % or more, more preferably 90 weight % or more of the total amount of all the color developing agents contained in the thermosensitive recording layer, which include the sulfonic acid compound represented by the above formula 1 and the diphenyl sulfone compound represented by the above formula 2.

Both of the thermosensitive recording layer and the protective layer of the present invention respectively comprise crosslinking agents.

As the crosslinking agent used in the present invention, zirconium compound, polyvalent aldehyde compound, methylol melamine, melamine formaldehyde resin, melamine urea resin, polyamine epichlorohydrin resin, polyamide epichlorohydrin resin, potassium persulfate, ammonium persulfate, sodium persulfate, ferric chloride, magnesium chloride, borax, boric acid, alums (aluminum potassium sulfate), ammonium chloride, and the like may be cited. The crosslinking agent is preferably zirconium compound, polyvalent aldehyde compound, methylol melamine, melamine formaldehyde resin, melamine urea resin, polyamine epichlorohydrin resin, polyamide epichlorohydrin resin, potassium persulfate, ammonium persulfate, sodium persulfate, ferric chloride, magnesium chloride, borax, boric acid, alums or ammonium chloride, more preferably zirconium compound or polyvalent aldehyde compound.

As the zirconium compound, zirconium chloride, zirconium sulfate, zirconium nitrate, zirconium acetate, zirconium carbonate, zirconium stearate, zirconium octylate, zirconium silicate, zirconium oxynitrate, potassium zirconium carbonate (zirconium carbonate potassium salt), ammonium zirconium carbonate (zirconium carbonate ammonium salt) and the like may be cited. The zirconium compound is preferably zirconium chloride, zirconium sulfate, zirconium nitrate, zirconium acetate, zirconium carbonate, zirconium stearate, zirconium octylate, zirconium silicate, oxy zirconium nitrate, potassium zirconium carbonate or ammonium zirconium carbonate. The zirconium compound is more preferably water-soluble and is further preferably, for example, zirconium nitrate, zirconium acetate, zirconium carbonate, potassium zirconium carbonate or ammonium zirconium carbonate, further more preferably ammonium zirconium carbonate.

As the polyvalent aldehyde compound, glyoxal, glutaraldehyde, aldehyde starch and the like may be cited. The polyvalent aldehyde compound is preferably glyoxal, glutaraldehyde or aldehyde starch, more preferably glyoxal.

At least one of the thermosensitive recording layer and the protective layer comprises an ammonium zirconium carbonate as the crosslinking agent. It is preferable that both of the thermosensitive recording layer and the protective layer respectively comprise ammonium zirconium carbonates as the crosslinking agent.

That is, in the thermosensitive recording medium of the present invention, (i) the thermosensitive recording layer comprises an ammonium zirconium carbonate and the protective layer comprises a crosslinking agent other than ammonium zirconium carbonate, (ii) the protective layer comprises an ammonium zirconium carbonate and the thermosensitive recording layer comprises a crosslinking agent other than ammonium zirconium carbonate, or (iii) both of the thermosensitive recording layer and the protective layer respectively comprise ammonium zirconium carbonates.

In the thermosensitive recording medium of the present invention, it is preferable that (iii) both of the thermosensitive recording layer and the protective layer respectively comprise ammonium zirconium carbonates.

The thermosensitive recording layer or the protective layer, which does not comprise an ammonium zirconium carbonate as the crosslinking agent, preferably comprises a crosslinking agent selected from the group consisting of (a) zirconium compounds other than ammonium zirconium carbonate and (b) polyvalent aldehyde compounds.

And it is preferable that the thermosensitive recording layer and/or the protective layer, which comprises an ammonium zirconium carbonate as the crosslinking agent, does not comprise a crosslinking agent other than ammonium zirconium carbonate. However, the thermosensitive recording layer and/or the protective layer, which comprises an ammonium zirconium carbonate, may comprise a crosslinking agent other than ammonium zirconium carbonate. In such a case, the crosslinking agent other than ammonium zirconium carbonate is preferably selected from the group consisting of (a) zirconium compounds other than ammonium zirconium carbonate and (b) polyvalent aldehyde compounds.

In the case wherein the thermosensitive recording layer and/or the protective layer, which comprises an ammonium zirconium carbonate as the crosslinking agent, comprises a crosslinking agent other than ammonium zirconium carbonate, the amount of the ammonium zirconium carbonate is preferably 50 weight % or more, more preferably 80 weight % or more, further preferably 90 weight % or more of the total amount of the crosslinking agents.

The amount (in solid) of the crosslinking agents in the thermosensitive recording layer is from 0.5 to 5.0 weight %, preferably from 1.0 to 3.0 weight %. The amount (in solid) of the crosslinking agents in the protective layer is from 2.0 to 10.0 weight %, preferably from 3.0 to 8.0 weight %.

It is preferable that the thermosensitive recording layer and the protective layer respectively comprise binders.

As the binder, polyvinyl alcohols, acrylic resins, cellulose derivatives, starches, styrene-maleic anhydride copolymer, styrene-butadiene copolymer, casein, gum Arabic, polyvinyl chloride, polyvinyl acetate, polyacrylamide, polyacrylic acid esters, polyvinyl butyral, polystyrose and copolymers thereof, polyamide resin, silicone resins, petroleum resins, terpene resins, ketone resins, cumaron resins and the like may be listed. The binder is preferably polyvinyl alcohols, acrylic resins, cellulose and derivatives thereof, starches, styrene-maleic anhydride copolymer, styrene-butadiene copolymer, casein, gum Arabic, polyvinyl chloride, polyvinyl acetate, polyacrylamide, polyacrylic acid esters, polyvinyl butyral, polystyrose and copolymers thereof; polyamide resin, silicone resins, petroleum resins, terpene resins, ketone resins or cumaron resins.

As the polyvinyl alcohols, completely saponified polyvinyl alcohol, partially saponified polyvinyl alcohol, acetoacetyl polyvinyl alcohol, carboxy-modified polyvinyl alcohol, amide-modified polyvinyl alcohol, sulfonic acid-modified polyvinyl alcohol, butyral modified polyvinyl alcohol, olefin modified polyvinyl alcohol, nitrile-modified polyvinyl alcohol, pyrrolidone modified polyvinyl alcohol, silicone modified polyvinyl alcohol, other modified polyvinyl alcohols and the like may be listed. The polyvinyl alcohols is preferably completely saponified polyvinyl alcohol, partially saponified polyvinyl alcohol, acetoacetyl polyvinyl alcohol, carboxy-modified polyvinyl alcohol, amide-modified polyvinyl alcohol, sulfonic acid-modified polyvinyl alcohol, butyral modified polyvinyl alcohol, olefin modified polyvinyl alcohol, nitrile-modified polyvinyl alcohol, pyrrolidone modified polyvinyl alcohol or silicone modified polyvinyl alcohol, more preferably completely saponified polyvinyl alcohol or carboxy-modified polyvinyl alcohol.

As the acrylic resins, acrylic resins comprising a (meth) acrylic acid and a monomer component (except olefin) that is copolymerizable with (meth) acrylic acid may be cited.

As the monomer component that is copolymerizable with (meth) acrylic acid, alkyl acrylate resins, such as methyl (meth) acrylate, ethyl (meth) acrylate, propyl (meth) acrylate, butyl (meth) acrylate, isobutyl (meth) acrylate, pentyl (meth) acrylate, hexyl (meth) acrylate, 2-ethyl hexyl (meth) acrylate, octyl (meth) acrylate, and the like; epoxy resins; silicone resins; modified alkyl acrylate resins, such as alkyl acrylate resin modified with styrene or its derivative; (meth) acrylonitrile; acrylic acid ester; hydroxyalkyl acrylic acid ester and the like may be listed. The monomer is preferably alkyl acrylate resins, such as methyl (meth) acrylic acid, ethyl (meth) acrylic acid, (meth) acrylic acid propyl, butyl (meth) acrylic acid, isobutyl (meth) acrylic acid, pentyl (meth) acrylate, hexyl (meth) acrylic acid, (meth) hexyl to acrylic acid-2-ethyl, octyl (meth) acrylic acid, and the like; epoxy resins; silicone resins; modified alkyl acrylate resins, such as alkyl acrylate resin modified with styrene or its derivative; (meth) acrylonitrile; acrylic acid ester; or hydroxyalkyl acrylic acid ester, more preferably the alkyl acrylate resins is (meth) acrylonitrile or methyl (meth) acrylic acid.

As the cellulose derivatives, hydroxyethyl cellulose, methyl cellulose, ethyl cellulose, carboxymethyl cellulose, acetyl cellulose and the like may be listed. The cellulose derivatives are preferably hydroxyethyl cellulose, methyl cellulose, ethyl cellulose, carboxymethyl cellulose or acetyl cellulose.

As the starches, oxidized starch, etherified starch, esterified starch and the like may be listed. The starches are preferably oxidized starch, etherified starch or esterified starch.

As the carboxyl group-containing resin used in the present invention, acrylic resins, carboxymethyl cellulose, carboxy modified polyvinyl alcohol and the like may be cited. The carboxyl group-containing resin is preferably acrylic resins, carboxymethyl cellulose or carboxy modified polyvinyl alcohol, more preferably acrylic resins or carboxy modified polyvinyl alcohol.

The binder used in the present invention is preferably is polyvinyl alcohols (except carboxy-modified polyvinyl alcohol) or carboxyl group-containing resin.

In particular, the binder contained in the thermosensitive recording layer is more preferably polyvinyl alcohols. And the binder contained in the protective layer is more preferably carboxyl group-containing resin or a combination of carboxyl group-containing resin and polyvinyl alcohols (except carboxy-modified polyvinyl alcohol).

These binders may be used upon dissolving in a solvent such as water, alcohol, ketones, esters, hydrocarbons and the like or may be used in the form of an emulsion or paste dispersed in water or other media. These may be used in combination depending on the required qualities.

The amount (in solid) of the binder in the thermosensitive recording layer is preferably from 5 to 25 weight %.

The amount (in solid) of the binder in the protective layer is preferably 20 weight % or more, preferably from 20 to 80 weight %. In the case wherein the protective layer comprises pigments, the amount (in solid) of the binder is preferably from 30 to 300 weight parts per 100 weight parts of the pigments.

The various materials used in the thermosensitive recording layer of the thermosensitive recording medium of the present invention are shown below. These materials (except leuco dye, color developing agent and sensitizer) may be used also for other coating layer(s), such as the protective layer.

All of the leuco dyes well known in the conventional field of pressure sensitive and thermosensitive recording media may be used as the electron donating leuco dye in the present invention. Although the leuco dye is not particularly restricted, triphenylmethane type compounds, fluorane type compounds, fluorene type compounds, divinyl type compounds and the like are preferred as the leuco dye. Specific examples of the typical colorless to pale colored basic colorless leuco dye (leuco dye precursors) are shown below. In addition, these leuco dye precursors may be used individually and also in mixtures of at least two of them.

<Triphenylmethane Type Leuco Dyes>

3,3-bis(p-Dimethyl aminophenyl)-6-dimethylaminophthalide [alternate name: crystal violet lactone] and 3,3-bis(p-Dimethyl aminophenyl) phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino) fluorane, 3-diethylamino-6-methyl-7-(o-fluoroanilino) fluorane, 3-diethylamino-6-methyl-7-(m-methyl anilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane, 3-diethylamino-6-chloro-7-methyl fluorane, 3-diethylamino-6-chloro-7-anilino fluorane, 3-diethylamino-6-chloro-7-p -methyl anilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino) fluorane, 3-diethylamino-7-(o-fluoroanilino) fluorane, 3-diethylamino-benz[a]fluorane, 3-diethylamino-benz[c] fluorane, 3-dibutylamino-6-methylfluorane, 3-dibutyl amino-6-methyl-7-anilino fluorane, 3-dibutylamino-6-methyl-7-(o,p-dimethylanilino) fluorane, 3-dibutylamino-7-(o-chloroanilino) fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino) fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p -methylanilino fluorane, 3-dibutylamino-7-(o-chloroanilino) fluorane, 3-dibutylamino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexyl amino)-6-methyl-7-anilino fluorane, 3-(N-ethyl-N-cyclohexylamino)-6-methyl-7-anilino fluorane, 3-(N-ethyl-N-xylyl amino)-6-methyl-7-(p-chloroanilino) fluorane, 3-(N-ethyl-p-toluidino)-6-methyl-7-anilino fluorane, 3-(N-ethyl-N iso amyl amino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-o-(p-dimethylaminophenyl)aminoanilino fluorane, 2-methoxy-6-p-(p-dimethylaminophenyl) aminoanilino fluorane, 2-chloro-3-methyl-6-p-(p-phenylaminophenyl) aminoanilino fluorane, 2-chloro-6-p-(p-dimethylaminophenyl) aminoanilino fluorane, 2-nitro-6-p-(p-diethylaminophenyl) aminoanilino fluorane, 2-amino-6-p-(p-diethylaminophenyl) aminoanilino fluorane, 2-diethylamino-6-p-(p-diethylaminophenyl) aminoanilino fluorane, 2-phenyl-6-methyl-6-p-(p-phenylaminophenyl) aminoanilino fluorane, 2-benzyl-6-p-(p-phenylaminophenyl) aminoanilino fluorane, 2-hydroxy-6-p-(p-phenylaminophenyl) aminoanilino fluorane, 3-methyl-6-p-(p-dimethylaminophenyl) aminoanilino fluorane, 3-diethylamino-6-p-(p-diethylaminophenyl) aminoanilino fluorane, 3-diethylamino-6-p-(p-dibutylaminophenyl) aminoanilino fluorane and 2,4-dimethyl-6-[(4-dimethylamino) anilino] fluorane.

<Fluorene Type Leuco Dye>

3,6,6-Tris(dimethylamino) spiro[fluorane-9,3'-phthalide] and 3,6,6'-tris (diethylamino) spiro[fluorane-9,3'-phthalide].

<Divinyl Type Leuco Dyes>

3,3-bis-[2-(p-dimethylaminophenyl)-2-(p-methoxyphenyl) ethenyl]-4,5,6,7-tetrabromophthalide, 3,3-bis-[2-(p-dimethylaminophenyl)-2-(p-methoxyphenyl) ethenyl]-4,5,6,7-tetrachlorophthalide, 3,3-bis-[1,1-bis(4-pyrrolidinophenyl) ethylene-2-yl]4,5,6,7-tetra-bromophthalide, 3,3-bis-[1-(4-methoxyphenyl)-1-(4-pyrrolidinophenyl) ethylene-2-yl]-4,5,6,7-tetrachlorophthalide <Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitroanilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

The previously well known sensitizers may be used as the sensitizer in the thermosensitive recording medium of the present invention. As such sensitizers, aliphatic acid amides such as stearic acid amide, palmitic acid amide and the like, ethylene bis-amide, montan acid wax, polyethylene wax, 1,2-di-(3-methylphenoxy) ethane, p-benzyl biphenyl, β-benzyloxy naphthalene, 4-biphenyl-p-tolyl ether, m-terphenyl, 1,2-diphenoxyethane, dibenzyl oxalate, di(p-chlorobenzyl) oxalate, di(p-methylbenzyl) oxalate, dibenzyl terephthalate, benzyl p-benzyloxy benzoate, di-p-tolyl carbonate, phenyl-α-naphthyl carbonate, 1,4-diethoxynaphthalene, 1-hydroxy-2-naphthoic acid phenyl ester, o-xylene-bis-(phenyl ether), 4-(m-methyl phenoxymethyl) biphenyl, 4,4'-ethylene dioxy-bis-benzoic acid dibenzyl ester, dibenzoyloxy methane, 1,2-di(3-methylphenoxy) ethylene, bis[2-(4-methoxy-phenoxy) ethyl] ether, methyl p-nitrobenzoate, phenyl p-toluene sulfonate, o-toluenesulfonamide, p-toluenesulfonamide, and the like may be listed as examples. These sensitizers may be used individually and as mixtures of at least two of them.

As a pigment used in the the present invention, kaolin, calcined kaolin, calcium carbonate, aluminum oxide, titanium oxide, magnesium carbonate, aluminum silicate, magnesium silicate, calcium silicate, aluminum hydroxide, silica and the like may be used. These pigments may be used in combinations depending on the required quality.

As the slipping agent used in the present invention, fatty acid metal salts such as zinc stearate, calcium stearate, and the like; waxes; silicone resins; and the like may be cited.

Stabilizing agents that improve oil resistance of recorded images and the like, such as 4,4'-butylidene (6-t-butyl-3-methylphenol), 2,2'-di-t-butyl-5,5'-dimethyl-4,4'-sulfonyl diphenol, 1,1,3-tris (2-methyl-4-hydroxy-5-cyclohexylphenyl) butane, 1,1,3-tris (2-methyl-4-hydroxy-5-t-butylphenyl) butane and the like may also be added in the range that does not adversely affect the desired effects for the problems described above.

In addition, a benzophenone type and triazole type UV absorber, dispersion agent, de-foaming agent, antioxidant, fluorescent dye and the like may also be used.

The types and amounts of the leuco dye, color developing agent, sensitizer and other various ingredients used in the thermosensitive recording medium of the present invention may be determined according to the required performance and printability. Although the amounts of the color developing agent, the sensitizer, the pigment, the stabilizing agent and the other ingredients are not particularly restricted, from 0.5 parts to 10 parts of the color developing agent, from 0.5 parts to 10 parts of the sensitizer, from 0.5 parts to 20 parts of the pigment, from 0.01 parts to 10 parts of the stabilizing agent and from 0.01 parts to 10 parts of the other ingredients are ordinarily used per 1 part of the leuco dye.

The leuco dye, the color developing agent and the materials added as needed are finely ground into particles with several microns or smaller in size, by using a grinder or a suitable emulsification device such as a ball mill, attritor, sand grinder and the like. The coating solutions are prepared by adding a binder and various additives to these depending on the objective. Water, alcohol and the like can be used as the solvent for the coating solution and the solid content of the coating solution is about from 20 to 40 weight %.

The thermosensitive recording medium of the present invention may further have an undercoat layer between the support and the thermosensitive recording layer.

The undercoat layer comprises mainly a binder and a pigment. As the binder for the undercoat layer, the binders shown above as the materials that can be used for the thermosensitive recording layer and the protective layer may be used. These binders may be used alone or in combination of two or more.

Any known pigment may be used as the pigment in the undercoat layer. As the pigment, for example, inorganic pigment, such as calcium carbonate, silica, zinc oxide, titanium oxide, aluminum hydroxide, magnesium hydroxide, calcined kaolin, clay, talc the like may be cited. These pigments may be used alone or in combination of two or more.

The amount of the pigments in the undercoat layer is ordinarily from 50 to 95 weight parts, preferably from 70 to 90 weight parts.

Various aids such as a dispersion agent, plasticizer, pH controlling agent, de-foaming agent, water retention agent, preservative, coloring dye, UV absorber and the like may be added to the undercoat layer, as required.

In the present invention, the method for coating the thermosensitive recording layer, the protective layer and other coating layers is not limited in particular, but any known conventional techniques may be used. The method for coating may be appropriately selected from off-machine coating machines and on-machine coating machines, which are equipped with coaters such as air knife coater, rod blade coater, bent blade coater, bevel blade coater, roll coater, curtain coater and the like.

The coating amount of the thermosensitive recording layer, the protective layer and other coating layers is not limited in particular, but may be determined according to the required performance and the recording suitability.

The typical dried coating amount of the thermosensitive recording layer is ordinarily in the range of from 2 to 12 $g/m^2$, and the typical dried coating amount of the protective layer is ordinarily in the range of from 1 to 5 $g/m^2$.

Furthermore, various technologies known in the thermosensitive recording medium field may be used as needed. For example, a flattening treatment such as super calendaring and the like can be applied after coating individual coating layers.

EXAMPLES

The following Examples illustrate the present invention, but the Examples are not intended to limit the scope of the present invention. In the following description, the terms parts and % indicate parts by weight and weight %, respectively.

The coatings and dispersions were prepared as described below.

[Preparation of Coating Solutions]

Undercoat layer coating solution was prepared by dispersing and stirring the following formulation:

Undercoat Layer Coating Solution

| | |
|---|---|
| Calcined kaolin (BASF Co.: Ansilex 90) | 100.0 parts |
| Styrene-butadiene copolymer latex (Zeon Corporation, ST5526, solid content: 48%) | 10.0 parts |
| Water | 50.0 parts |

Color developing agent dispersions (Solutions A1 to A4), a leuco dye dispersion (Solution B) and a sensitizer dispersion (Solution C) with the following formulations were separately wet ground using sand grinders until the average particle sizes were about 0.5 μm.

Color Developing Agent Dispersion (Solution A1)

| | |
|---|---|
| Sulfonic acid compound represented by the formula 1 (BASF Co., DP201) | 6.0 parts |
| Aqueous solution of completely saponified polyvinyl alcohol (Kuraray Co., Ltd., PVA117, solid content: 10%) | 5.0 parts |
| Water | 1.5 parts |

Color Developing Agent Dispersion (Solution A2)

| | |
|---|---|
| 4-hydroxy-4'-allyloxy-diphenylsulfone (Nicca Chemical Co., Ltd., BPS-MAE) | 6.0 parts |
| Aqueous solution of completely saponified polyvinyl alcohol (PVA117) | 5.0 parts |
| Water | 1.5 parts |

Color Developing Agent Dispersion (Solution A3)

| | |
|---|---|
| bis(3-allyl-4-hydroxyphenyl) sulfone (Nippon Kayaku Co., Ltd., TG-SA) | 6.0 parts |
| Aqueous solution of completely saponified polyvinyl alcohol (PVA117) | 5.0 parts |
| Water | 1.5 parts |

Color Developing Agent Dispersion (Solution A4)

| | |
|---|---|
| Urea-urethane type diphenyl sulfone compound represented by the formula 5 (Chemipro Kasei Kaisha, LTD., UU) | 6.0 parts |
| Aqueous solution of completely saponified polyvinyl alcohol (PVA117) | 5.0 parts |
| Water | 1.5 parts |

Leuco Dye Dispersion (Solution B)

| | |
|---|---|
| 3-Dibutylamino-6-methyl-7-anilinofluorane (Yamamoto Chemicals Inc., ODB-2) | 6.0 parts |
| Aqueous solution of completely saponified polyvinyl alcohol (PVA117) | 5.0 parts |
| Water | 1.5 parts |

Sensitizer Dispersion (Solution C)

| | |
|---|---|
| 1,2-bis(2-Methylphenoxy) ethane (Sanko Co. Ltd, KS232) | 6.0 parts |
| Aqueous solution of completely saponified polyvinyl alcohol (PVA117) | 5.0 parts |
| Water | 1.5 parts |

Next, these dispersions were blended in the proportion described below to prepare the thermosensitive recording layer coating solutions 1 to 11.

Thermosensitive Recording Layer Coating Solution 1

| | |
|---|---|
| Color developing agent dispersion (Solution A1) | 18.0 parts |
| Color developing agent dispersion (Solution A2) | 18.0 parts |
| Leuco dye dispersion (Solution B) | 18.0 parts |
| Sensitizer dispersion (Solution C) | 36.0 parts |
| Silica dispersion (Mizusawa Industrial Chemicals, Ltd., Mizukasil P-537, solid content: 25%) | 17.5 parts |
| Aqueous solution of completely saponified polyvinyl alcohol (PVA117) | 30.0 parts |
| Glyoxal (Nippon Synthetic Chemical Industry Co., Ltd., solid content: 40%) | 2.5 parts |

Thermosensitive Recording Layer Coating Solution 2

| | |
|---|---|
| Color developing agent dispersion (Solution A1) | 18.0 parts |
| Color developing agent dispersion (Solution A2) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |
| Ammonium zirconium carbonate 45% aqueous solution (San Nopco Limited, AZ Coat 5800MT) | 1.5 parts |

Thermosensitive Recording Layer Coating Solution 3

| | |
|---|---|
| Color developing agent dispersion (Solution A1) | 18.0 parts |
| Color developing agent dispersion (Solution A2) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |

Thermosensitive Recording Layer Coating Solution 4

| | |
|---|---|
| Color developing agent dispersion (Solution A3) | 18.0 parts |
| Color developing agent dispersion (Solution A2) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |

Thermosensitive Recording Layer Coating Solution 5

| | |
|---|---|
| Color developing agent dispersion (Solution A1) | 36.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |

Thermosensitive Recording Layer Coating Solution 6

| | |
|---|---|
| Color developing agent dispersion (Solution A1) | 18.0 parts |
| Color developing agent dispersion (Solution A2) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |
| Polyamide epichlorohydrin (Seiko PMC: WS4020, solid content: 25%) | 3.0 parts |

Thermosensitive Recording Layer Coating Solution 7

| | |
|---|---|
| Color developing agent dispersion (Solution A1) | 18.0 parts |
| Color developing agent dispersion (Solution A4) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |
| Glyoxal (Nippon Synthetic Chemical Industry Co., Ltd.) | 2.5 parts |

Thermosensitive Recording Layer Coating Solution 8

| | |
|---|---|
| Color developing agent dispersion (Solution A1) | 18.0 parts |
| Color developing agent dispersion (Solution A4) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |
| Ammonium zirconium carbonate 45% aqueous solution (AZ Coat 5800MT) | 1.5 parts |

Thermosensitive Recording Layer Coating Solution 9

| | |
|---|---|
| Color developing agent dispersion (Solution A1) | 18.0 parts |
| Color developing agent dispersion (Solution A4) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |

Thermosensitive Recording Layer Coating Solution 10

| | |
|---|---|
| Color developing agent dispersion (Solution A3) | 18.0 parts |
| Color developing agent dispersion (Solution A4) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |

Thermosensitive Recording Layer Coating Solution 11

| | |
|---|---|
| Color developing agent dispersion (Solution A1) | 18.0 parts |
| Color developing agent dispersion (Solution A4) | 18.0 parts |
| Leuco dye dispersion (Solution B) | 18.0 parts |
| Sensitizer dispersion (Solution C) | 36.0 parts |
| Silica dispersion (Mizukasil P-537) | 17.5 parts |
| Aqueous solution of completely saponified polyvinyl alcohol (PVA117) | 30.0 parts |
| Polyamide epichlorohydrin (WS4020) | 3.0 parts |

Next, protective layer coating solutions 1 to 7 were prepared by mixing the following formulations:

Protective Layer Coating Solution 1

| | |
|---|---|
| Aluminum hydroxide dispersion (Martinsberg: Martifin OL, solid content: 50%) | 9.0 parts |
| Non-core-shell type acrylic resin emulsion (Mitsui Chemicals, Inc., ASN1004K, Tg 55 degree C., solid content 18%) | 25.0 parts |
| Ammonium zirconium carbonate 45% aqueous solution (AZ Coat 5800MT) | 1.0 parts |
| Zinc stearate dispersion (Chukyo Yushi Co., Ltd.: HydrinZ-7-30, solid content: 30%) | 2.0 parts |

Protective Layer Coating Solution 2

| | |
|---|---|
| Aluminum hydroxide dispersion (Martifin OL) | 9.0 parts |
| Non-core-shell type acrylic resin emulsion (ASN1004K) | 25.0 parts |
| Glyoxal (Nippon Synthetic Chemical Industry Co., Ltd.) | 1.7 parts |
| Zinc stearate dispersion (HydrinZ-7-30) | 2.0 parts |

Protective Layer Coating Solution 3

| | |
|---|---|
| Aluminum hydroxide dispersion (Martifin OL) | 9.0 parts |
| Carboxyl modified polyvinyl alcohol solution (Kuraray Co., Ltd.: KL318, solid content: 10%) | 30.0 parts |
| Ammonium zirconium carbonate 45% aqueous solution (AZ Coat 5800MT) | 0.7 parts |
| Zinc stearate dispersion (HydrinZ-7-30) | 2.0 parts |

Protective Layer Coating Solution 4

| | |
|---|---|
| Aluminum hydroxide dispersion (Martifin OL) | 9.0 parts |
| Aqueous solution of completely saponified polyvinyl alcohol (PVA117) | 30.0 parts |
| Ammonium zirconium carbonate 45% aqueous solution (AZ Coat 5800MT) | 0.7 parts |
| Zinc stearate dispersion (HydrinZ-7-30) | 2.0 parts |

Protective Layer Coating Solution 5

| | |
|---|---|
| Aluminum hydroxide dispersion (Martifin OL) | 9.0 parts |
| Carboxyl modified polyvinyl alcohol solution (KL318) | 30.0 parts |
| Polyamide epichlorohydrin (WS4020) | 2.5 parts |
| Zinc stearate dispersion (HydrinZ-7-30) | 2.0 parts |

Protective Layer Coating Solution 6

| | |
|---|---|
| Aluminum hydroxide dispersion (Martifin OL) | 9.0 parts |
| Non-core-shell type acrylic resin emulsion (ASN1004K) | 25.0 parts |
| Zinc stearate dispersion (HydrinZ-7-30) | 2.0 parts |

Protective Layer Coating Solution 7

| | |
|---|---|
| Aluminum hydroxide dispersion (Martifin OL) | 9.0 parts |
| Non-core-shell type acrylic resin emulsion (ASN1004K) | 25.0 parts |
| Polyamide epichlorohydrin (WS4020) | 3.0 parts |
| Zinc stearate dispersion (HydrinZ-7-30) | 2.0 parts |

Example 1

The undercoat layer coating solution was applied on one side of a support (groundwood free paper with a basis weight of 47 g/m$^2$) by using a bent blade coater with a coating amount (in solid) of 10.0 g/m$^2$, and was dried to prepare an undercoated paper.

The thermosensitive recording layer coating solution 1 was applied on the undercoat layer of the undercoated paper by using a rod blade coater with a coating amount (in solid) of 6.0 g/m$^2$ and was dried and super calendared so that the smoothness was 500-1,000 seconds to prepare a thermosensitive recording layer coated paper.

Then the protective layer coating solution 1 was applied on the thermosensitive recording layer of the thermosensitive recording layer coated paper by using a rod blade coater with a coating amount (in solid) of 3.0 g/m$^2$ and was dried to prepare a thermosensitive recording medium.

Example 2

A thermosensitive recording medium was prepared in the same manner as described in Example 1 using the thermosensitive recording layer coating solution 2 in place of the thermosensitive recording layer coating solution 1 and using the protective layer coating solution 2 in place of the protective layer coating solution 1.

Example 3

A thermosensitive recording medium was prepared in the same manner as described in Example 1 using the thermosensitive recording layer coating solution 2 in place of the thermosensitive recording layer coating solution 1.

Example 4

A thermosensitive recording medium was prepared in the same manner as described in Example 1 using the thermosensitive recording layer coating solution 3 in place of the thermosensitive recording layer coating solution 1.

Example 5

A thermosensitive recording medium was prepared in the same manner as described in Example 1 using the thermosensitive recording layer coating solution 2 in place of the thermosensitive recording layer coating solution 1 and using the protective layer coating solution 3 in place of the protective layer coating solution 1.

Example 6

A thermosensitive recording medium was prepared in the same manner as described in Example 1 using the thermosensitive recording layer coating solution 2 in place of the thermosensitive recording layer coating solution 1 and using the protective layer coating solution 4 in place of the protective layer coating solution 1.

Example 7

A thermosensitive recording medium was prepared in the same manner as described in Example 1 using the thermosensitive recording layer coating solution 7 in place of the thermosensitive recording layer coating solution 1.

Example 8

A thermosensitive recording medium was prepared in the same manner as described in Example 7 using the thermosensitive recording layer coating solution 8 in place of the thermosensitive recording layer coating solution 7 and using the protective layer coating solution 2 in place of the protective layer coating solution 1.

Example 9

A thermosensitive recording medium was prepared in the same manner as described in Example 7 using the thermosensitive recording layer coating solution 8 in place of the thermosensitive recording layer coating solution 7.

Example 10

A thermosensitive recording medium was prepared in the same manner as described in Example 7 using the protective layer coating solution 3 in place of the protective layer coating solution 1.

Example 11

A thermosensitive recording medium was prepared in the same manner as described in Example 7 using the thermosensitive recording layer coating solution 8 in place of the thermosensitive recording layer coating solution 7 and using the protective layer coating solution 3 in place of the protective layer coating solution 1.

Example 12

A thermosensitive recording medium was prepared in the same manner as described in Example 7 using the thermosensitive recording layer coating solution 8 in place of the thermosensitive recording layer coating solution 7 and using the protective layer coating solution 4 in place of the protective layer coating solution 1.

Comparative Example 1

A thermosensitive recording medium was prepared in the same manner as described in Example 1 using the thermosensitive recording layer coating solution 3 in place of the thermosensitive recording layer coating solution 1 and using the protective layer coating solution 5 in place of the protective layer coating solution 1.

Comparative Example 2

A thermosensitive recording medium was prepared in the same manner as described in Example 1 using the thermosensitive recording layer coating solution 4 in place of the thermosensitive recording layer coating solution 1 and using the protective layer coating solution 5 in place of the protective layer coating solution 1.

Comparative Example 3

A thermosensitive recording medium was prepared in the same manner as described in Example 1 using the thermosensitive recording layer coating solution 5 in place of the thermosensitive recording layer coating solution 1 and using the protective layer coating solution 5 in place of the protective layer coating solution 1.

Comparative Example 4

A thermosensitive recording medium was prepared in the same manner as described in Example 1 using the thermosensitive recording layer coating solution 3 in place of the thermosensitive recording layer coating solution 1 and using the protective layer coating solution 6 in place of the protective layer coating solution 1.

Comparative Example 5

A thermosensitive recording medium was prepared in the same manner as described in Example 1 using the thermosensitive recording layer coating solution 3 in place of the thermosensitive recording layer coating solution 1.

Comparative Example 6

A thermosensitive recording medium was prepared in the same manner as described in Example 1 using the thermosensitive recording layer coating solution 3 in place of the thermosensitive recording layer coating solution 1 and using the protective layer coating solution 7 in place of the protective layer coating solution 1.

Comparative Example 7

A thermosensitive recording medium was prepared in the same manner as described in Example 1 using the protective layer coating solution 6 in place of the protective layer coating solution 1.

Comparative Example 8

A thermosensitive recording medium was prepared in the same manner as described in Example 1 using the thermosensitive recording layer coating solution 6 in place of the thermosensitive recording layer coating solution 1 and using the protective layer coating solution 6 in place of the protective layer coating solution 1.

Comparative Example 9

A thermosensitive recording medium was prepared in the same manner as described in Example 1 using the protective layer coating solution 2 in place of the protective layer coating solution 1.

Comparative Example 10

A thermosensitive recording medium was prepared in the same manner as described in Example 1 using the thermosensitive recording layer coating solution 6 in place of the thermosensitive recording layer coating solution 1 and using the protective layer coating solution 7 in place of the protective layer coating solution 1.

Comparative Example 11

A thermosensitive recording medium was prepared in the same manner as described in Example 7 using the thermosensitive recording layer coating solution 9 in place of the thermosensitive recording layer coating solution 7 and using the protective layer coating solution 5 in place of the protective layer coating solution 1.

Comparative Example 12

A thermosensitive recording medium was prepared in the same manner as described in Example 7 using the thermosensitive recording layer coating solution 10 in place of the thermosensitive recording layer coating solution 7 and using the protective layer coating solution 5 in place of the protective layer coating solution 1.

Comparative Example 13

A thermosensitive recording medium was prepared in the same manner as described in Example 7 using the thermosensitive recording layer coating solution 9 in place of the thermosensitive recording layer coating solution 7 and using the protective layer coating solution 6 in place of the protective layer coating solution 1.

Comparative Example 14

A thermosensitive recording medium was prepared in the same manner as described in Example 7 using the thermosensitive recording layer coating solution 9 in place of the thermosensitive recording layer coating solution 7.

Comparative Example 15

A thermosensitive recording medium was prepared in the same manner as described in Example 7 using the thermosensitive recording layer coating solution 9 in place of the thermosensitive recording layer coating solution 7 and using the protective layer coating solution 7 in place of the protective layer coating solution 1.

Comparative Example 16

A thermosensitive recording medium was prepared in the same manner as described in Example 7 using the protective layer coating solution 6 in place of the protective layer coating solution 1.

Comparative Example 17

A thermosensitive recording medium was prepared in the same manner as described in Example 7 using the thermosensitive recording layer coating solution 11 in place of the thermosensitive recording layer coating solution 7 and using the protective layer coating solution 6 in place of the protective layer coating solution 1.

Comparative Example 18

A thermosensitive recording medium was prepared in the same manner as described in Example 7 using the protective layer coating solution 2 in place of the protective layer coating solution 1.

Comparative Example 19

A thermosensitive recording medium was prepared in the same manner as described in Example 7 using the thermosensitive recording layer coating solution 11 in place of the thermosensitive recording layer coating solution 7 and using the protective layer coating solution 7 in place of the protective layer coating solution 1.

Comparative Example 20

A thermosensitive recording medium was prepared in the same manner as described in Example 1 using the thermosensitive recording layer coating solution 1 with the exception of changing the amount of the color developing agent dispersion (Solution A1) from 18.0 parts to 36.0 parts and not using the color developing agent dispersion (Solution A2).

Comparative Example 21

A thermosensitive recording medium was prepared in the same manner as described in Example 1 using the thermosensitive recording layer coating solution 1 with the exception of using the color developing agent dispersion (Solution A3) in place of the color developing agent dispersion (Solution A2).

Comparative Example 22

A thermosensitive recording medium was prepared in the same manner as described in Example 2 using the thermosensitive recording layer coating solution 2 with the exception of changing the amount of the color developing agent dispersion (Solution A1) from 18.0 parts to 36.0 parts and not using the color developing agent dispersion (Solution A2).

Comparative Example 23

A thermosensitive recording medium was prepared in the same manner as described in Example 2 using the thermosensitive recording layer coating solution 2 with the exception of using the color developing agent dispersion (Solution A3) in place of the color developing agent dispersion (Solution A2).

Comparative Example 24

A thermosensitive recording medium was prepared in the same manner as described in Example 7 using the thermosensitive recording layer coating solution 7 with the exception of changing the amount of the color developing agent dispersion (Solution A4) from 18.0 parts to 36.0 parts and not using the color developing agent dispersion (Solution A1).

Comparative Example 25

A thermosensitive recording medium was prepared in the same manner as described in Example 7 using the thermosensitive recording layer coating solution 7 with the exception of using the color developing agent dispersion (Solution A3) in place of the color developing agent dispersion (Solution A1).

Comparative Example 26

A thermosensitive recording medium was prepared in the same manner as described in Example 8 using the thermosensitive recording layer coating solution 8 with the exception of changing the amount of the color developing agent dispersion (Solution A4) from 18.0 parts to 36.0 parts and not using the color developing agent dispersion (Solution A1).

Comparative Example 27

A thermosensitive recording medium was prepared in the same manner as described in Example 8 using the thermosensitive recording layer coating solution 8 with the exception of using the color developing agent dispersion (Solution A3) in place of the color developing agent dispersion (Solution A1).

Comparative Example 28

A thermosensitive recording medium was prepared in the same manner as described in Example 1 using the thermosensitive recording layer coating solution 1 with the exception of changing the amount of the color developing agent dispersion (Solution A2) from 18.0 parts to 36.0 parts and not using the color developing agent dispersion (Solution A1).

Comparative Example 29

A thermosensitive recording medium was prepared in the same manner as described in Example 1 using the thermosensitive recording layer coating solution 1 with the exception of using the color developing agent dispersion (Solution A3) in place of the color developing agent dispersion (Solution A1).

Comparative Example 30

A thermosensitive recording medium was prepared in the same manner as described in Example 2 using the thermosensitive recording layer coating solution 2 with the exception of changing the amount of the color developing agent dispersion (Solution A2) from 18.0 parts to 36.0 parts and not using the color developing agent dispersion (Solution A1).

Comparative Example 31

A thermosensitive recording medium was prepared in the same manner as described in Example 2 using the thermosensitive recording layer coating solution 2 with the exception of using the color developing agent dispersion (Solution A3) in place of the color developing agent dispersion (Solution A1).

The prepared thermosensitive recording media were evaluated as below.

<Color Developing Property (Recorded Density)>

A checkerboard pattern was painted on the prepared thermosensitive recording media by using a thermosensitive recording medium print tester (Ohkura Engineering Co., Ltd. TH-PMD equipped with a thermal head by Kyocera Co.) at applied energy of 0.35 mJ/dot and printing speed of 50 mm/sec. The density of the printed portion was measured by using Macbeth Densitometer (RD-914, with Amber filter) to evaluate the color developing property.

<Heat Discoloration Resistance in Blank Portion>

The prepared thermosensitive recording medium was treated in an environment of 80 degree C. for 24 hours and stored in an environment of 23 degree C., 50% RH for three hours. The color density of non-printed portion (i.e. blank portion) was measured by using Macbeth Densitometer (RD-914, with Amber filter) to calculate the background color value from the difference between the color densities before and after the treatment. The heat discoloration resistance in the blank portion was evaluated on the following criteria. If the evaluation is rated as Excellent or Good, no problem happens in the practical use.

Background color value=(color density of the non-printing portion after the treatment)−(color density of the non-printing portion before the treatment)

Excellent: The background color value is less than 0.1

Good: The background color value is 0.1 or higher and less than 0.3

Fair: The background color value is 0.3 or higher and less than 0.5

Poor: The background color value is 0.5 or higher

<Bar Code Readability>

The prepared thermosensitive recording medium was treated in an environment of 80 degree C. for 24 hours and stored in an environment of 23 degree C., 50% RH for three hours. Then a bar code (CODE39) was printed on the thermosensitive recording medium by using a label printer 140XiIII manufactured by Zebra Co., Ltd. at print level of plus 20 and print speed of 0.1 cm per sec. (4 inches per sec.). The printed bar code was evaluated by using a bar code tester (Honeywell, QCPC600, light source: 640 nm). The bar code readability was evaluated according to the symbol grades of the ANSI standard as in the manner described below.

Symbol Grade: The bar code is divided into ten pieces in the direction vertical to the bar. The reading test is conducted once each. And the averaged bar code readability is evaluated as the following rating:

Rating: (Excellent) A>B>C>D>F (Poor)

If the evaluation is rated as A or B, no problem happens in the practical use.

<Printing Run-Ability (Anti-Sticking Property)>

A solid pattern (7.5 cm in width and 10 cm in length) was printed on the prepared thermosensitive recording medium by using a print tester (Canon Inc., HT180) at applied energy of 0.20 mJ/dot and at zero degree C. The condition of this printing was evaluated on the following criteria. If the evaluation is rated as Excellent or Good, no problem happens in the practical use.

Excellent: No unprinted area is observed in the printed solid pattern.

Good: Slight unprinted area (1-5 places) is observed in the printed solid pattern.

Fair: Unprinted area (6-10 places) is observed in the printed solid pattern.

Poor: Frequent unprinted area (11 places or more) is observed in the printed solid pattern.

"Unprinted area" means that printing is partially incomplete because the outermost layer of the recording medium sticks to the printing head of the print tester.

<Water Resistance>

A checkerboard pattern was painted on the prepared thermosensitive recording media by using a thermosensitive recording medium print tester (Ohkura Engineering Co., Ltd. TH-PMD equipped with a thermal head by Kyocera Co.) at applied energy of 0.35 mJ/dot and printing speed of 50 mm/sec.

The printed samples were immersed in tap water at 40 degree C. and left standing for 24 hours, then were air dried.

The color density of the air dried samples were measured by using Macbeth Densitometer (RD-914, with Amber filter) to calculate the residual ratio from the difference between the color densities before and after the immersion treatment.

The water resistance was evaluated on the following criteria. If the evaluation is rated as Excellent or Good, no problem happens in the practical use.

Residual ratio=[developed color intensity after the treatment/developed color intensity before the treatment]×100 (%)

Excellent: The residual ratio is 80% or higher

Good: The residual ratio is 60% or higher and less than 80%

Fair: The residual ratio is 40% or higher and less than 60%

Poor: The residual ratio is less than 40%

The evaluation results are shown in Tables 1 to 3.

TABLE 1

| | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|
| thermosensitive recording layer | color developing agent 1 | DP201 | DP201 | DP201 | DP201 | DP201 | DP201 | DP201 | TGSA | DP201 |
| | color developing agent 2 | BPS-MAE | BPS-MAE | BPS-MAE | BPS-MAE | BPS-MAE | BPS-MAE | BPS-MAE | BPS-MAE | — |
| | binder | PVA | PVA | PVA | PVA | PVA | PVA | PVA | PVA | PVA |
| | crosslinking agent | Glyoxal | Zr C. | Zr C. | Glyoxal | Zr C. | Zr C. | NA | NA | NA |
| protective layer | binder | acryl. | acryl. | acryl. | C-PVA | C-PVA | PVA | C-PVA | C-PVA | C-PVA |
| | crosslinking agent | Zr C. | Glyoxal | Zr C. | Zr C. | Zr C. | Zr C. | PAE | PAE | PAE |
| Color developing property | | 1.32 | 1.32 | 1.33 | 1.27 | 1.26 | 1.28 | 1.31 | 1.36 | 1.33 |
| Heat discoloration resistance in blank portion | | Good | Good | Excellent | Good | Excellent | Excellent | Excellent | Poor | Fair |
| Bar code readability | | B | B | A | B | A | A | A | D | C |
| Printing run-ability (anti-sticking property) | | Good | Excellent | Excellent | Good | Excellent | Excellent | Poor | Poor | Fair |
| Water resistance | | Good | Excellent | Excellent | Good | Excellent | Excellent | Poor | Fair | Fair |

| | | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|
| thermosensitive recording layer | color developing agent 1 | DP201 | DP201 | DP201 | DP201 | DP201 | DP201 | DP201 |
| | color developing agent 2 | BPS-MAE | BPS-MAE | BPS-MAE | BPS-MAE | BPS-MAE | BPS-MAE | BPS-MAE |
| | binder | PVA | PVA | PVA | PVA | PVA | PVA | PVA |
| | crosslinking agent | NA | NA | NA | Glyoxal | PAE | Glyoxal | PAE |
| protective layer | binder | acryl. | acryl. | acryl. | acryl. | acryl. | acryl. | acryl. |
| | crosslinking agent | NA | Zr C. | PAE | NA | NA | Glyoxal | PAE |
| Color developing property | | 1.32 | 1.32 | 1.32 | 1.32 | 1.31 | 1.32 | 1.31 |
| Heat discoloration resistance in blank portion | | Excellent | Excellent | Excellent | Good | Excellent | Excellent | Excellent |
| Bar code readability | | A | A | A | B | B | B | B |
| Printing run-ability (anti-sticking property) | | Poor | Poor | Poor | Good | Good | Good | Good |
| Water resistance | | Poor | Fair | Poor | Fair | Fair | Fair | Fair |

* PVA: completely saponified polyvinyl alcohol; acryl.: Non-core-shell type acrylic resin emulsion; Zr C.: ammonium zirconium carbonate; C-PVA: Carboxyl modified polyvinyl alcohol; PAE: Polyamide epichlorohydrin

TABLE 2

| | | Example 7 | Example 8 | Example 9 | Example 10 | Example 11 | Example 12 | Comparative Example 11 | Comparative Example 12 |
|---|---|---|---|---|---|---|---|---|---|
| thermosensitive recording layer | color developing agent 1 | DP201 | DP201 | DP201 | DP201 | DP201 | DP201 | DP201 | TGSA |
| | color developing agent 2 | UU | UU | UU | UU | UU | UU | UU | UU |
| | binder | PVA | PVA | PVA | PVA | PVA | PVA | PVA | PVA |
| | crosslinking agent | Glyoxal | Zr C. | Zr C. | Glyoxal | Zr C. | Zr C. | NA | NA |
| protective layer | binder | acryl. | acryl. | acryl. | C-PVA | C-PVA | PVA | C-PVA | C-PVA |
| | crosslinking agent | Zr C. | Glyoxal | Zr C. | Zr C. | Zr C. | Zr C. | PAE | PAE |
| Color developing property | | 1.29 | 1.29 | 1.30 | 1.24 | 1.23 | 1.25 | 1.28 | 1.33 |
| Heat discoloration resistance in blank portion | | Good | Good | Excellent | Good | Excellent | Excellent | Excellent | Poor |
| Bar code readability | | B | B | A | B | A | A | A | D |
| Printing run-ability (anti-sticking property) | | Good | Excellent | Excellent | Good | Excellent | Excellent | Poor | Poor |
| Water resistance | | Good | Excellent | Excellent | Good | Excellent | Excellent | Poor | Fair |

| | | Comparative Example 13 | Comparative Example 14 | Comparative Example 15 | Comparative Example 16 | Comparative Example 17 | Comparative Example 18 | Comparative Example 19 |
|---|---|---|---|---|---|---|---|---|
| thermosensitive recording layer | color developing agent 1 | DP201 | DP201 | DP201 | DP201 | DP201 | DP201 | DP201 |
| | color developing agent 2 | UU | UU | UU | UU | UU | UU | UU |

TABLE 2-continued

| | | | | | | | | |
|---|---|---|---|---|---|---|---|---|
| | binder | PVA | PVA | PVA | PVA | PVA | PVA | PVA |
| | crosslinking agent | NA | NA | NA | Glyoxal | PAE | Glyoxal | PAE |
| protective layer | binder | acryl. | acryl. | acryl. | acryl. | acryl. | acryl. | acryl. |
| | crosslinking agent | NA | Zr C. | PAE | NA | NA | Glyoxal | PAE |
| Color developing property | | 1.29 | 1.29 | 1.29 | 1.29 | 1.28 | 1.29 | 1.28 |
| Heat discoloration resistance in blank portion | | Excellent | Excellent | Excellent | Good | Excellent | Excellent | Excellent |
| Bar code readability | | A | A | A | B | B | B | B |
| Printing run-ability (anti-sticking property) | | Poor | Poor | Poor | Good | Good | Good | Good |
| Water resistance | | Poor | Fair | Poor | Fair | Fair | Fair | Fair |

* PVA: completely saponified polyvinyl alcohol; acryl.: Non-core-shell type acrylic resin emulsion; Zr C.: ammonium zirconium carbonate; C-PVA: Carboxyl modified polyvinyl alcohol; PAE: Polyamide epichlorohydrin

TABLE 3

| | | Comparative Example 20 | Comparative Example 21 | Comparative Example 22 | Comparative Example 23 | Comparative Example 24 | Comparative Example 25 | Comparative Example 26 | Comparative Example 27 |
|---|---|---|---|---|---|---|---|---|---|
| thermosensitive recording layer | color developing agent 1 | DP201 | DP201 | DP201 | DP201 | UU | UU | UU | UU |
| | color developing agent 2 | — | TGSA | — | TGSA | — | TGSA | — | TGSA |
| | binder | PVA | PVA | PVA | PVA | PVA | PVA | PVA | PVA |
| | crosslinking agent | Glyoxal | Glyoxal | Zr C. | Zr C. | Glyoxal | Glyoxal | Zr C. | Zr C. |
| protective layer | binder | acryl. | acryl. | acryl. | acryl. | acryl. | acryl. | acryl. | acryl. |
| | crosslinking agent | Zr C. | Zr C. | Glyoxal | Glyoxal | Zr C. | Zr C. | Glyoxal | Glyoxal |
| Color developing property | | 1.33 | 1.36 | 1.33 | 1.36 | 1.16 | 1.26 | 1.16 | 1.26 |
| Heat discoloration resistance in blank portion | | Fair | Poor | Fair | Poor | Good | Poor | Good | Poor |
| Bar code readability | | C | D | C | D | C | D | C | D |
| Printing run-ability (anti-sticking property) | | Good | Good | Excellent | Excellent | Good | Good | Excellent | Excellent |
| Water resistance | | Good | Good | Excellent | Excellent | Good | Good | Excellent | Excellent |

| | | Comparative Example 28 | Comparative Example 29 | Comparative Example 30 | Comparative Example 31 |
|---|---|---|---|---|---|
| thermosensitive recording layer | color developing agent 1 | BPS-MAE | BPS-MAE | BPS-MAE | BPS-MAE |
| | color developing agent 2 | — | TGSA | — | TGSA |
| | binder | PVA | PVA | PVA | PVA |
| | crosslinking agent | Glyoxal | Glyoxal | Zr C. | Zr C. |
| protective layer | binder | acryl. | acryl. | acryl. | acryl. |
| | crosslinking agent | Zr C. | Zr C. | Glyoxal | Glyoxal |
| Color developing property | | 1.35 | 1.38 | 1.35 | 1.38 |
| Heat discoloration resistance in blank portion | | Fair | Poor | Fair | Poor |
| Bar code readability | | C | F | C | F |
| Printing run-ability (anti-sticking property) | | Good | Good | Excellent | Excellent |
| Water resistance | | Good | Good | Excellent | Excellent |

* PVA: completely saponified polyvinyl alcohol; acryl.: Non-core-shell type acrylic resin emulsion; Zr C.: ammonium zirconium carbonate; C-PVA: Carboxyl modified polyvinyl alcohol; PAE: Polyamide epichlorohydrin Even though the thermosensitive recording layer comprises the combination of the two kinds of the color developing agents of the present invention, the sulfonic acid compound and the diphenyl sulfone compound, if a crosslinking agent is disregarded, the printing run-ability (anti-sticking property) and the water resistance are poor, while the heat discoloration resistance in blank portion and the bar code readability are excellent (see Comparative Examples 1, 4, 11, 13, etc.).

However, if both of the thermosensitive recording layer and the protective layer respectively comprise crosslinking agents, the printing run-ability (anti-sticking property) and the water resistance can be somewhat improved with maintaining the heat discoloration resistance in blank portion and the bar code readability in a proper range (compare Comparative Examples 9, 10, 18 and 19 with Comparative Examples 1, 4, 11 and 13).

Furthermore, if both of the thermosensitive recording layer and the protective layer respectively comprise crosslinking agents and at least one of the thermosensitive recording layer and the protective layer comprises an ammonium zirconium carbonate as the crosslinking agent, these properties are further improved with a good balance (compare Examples 1 to 12 with Comparative Examples 9, 10, 18 and 19).

On the other hand, in the case that the crosslinking agents are contained, if it is not considered to use a suitable color developing agent, the heat discoloration resistance in blank portion and the bar code readability are poor, while the printing run-ability (anti-sticking property) and the water resistance are good or excellent (see Comparative Examples 20 to 31.).

Therefore, if the thermosensitive recording layer comprises, as the electron accepting color developing agent, the sulfonic acid compound and the diphenyl sulfone compound of the present invention, both of the thermosensitive recording layer and the protective layer respectively comprise crosslinking agents, and at least one of the thermosensitive recording layer and the protective layer comprises an ammonium zirconium carbonate as the crosslinking agent, the printing run-ability (anti-sticking property) and the water resistance can be good or excellent while the heat discoloration resistance in blank portion and the bar code readability are maintained good or excellent (compare Examples 1 and 7 with Comparative Examples 20 and 21, Examples 2 and 8 with Comparative Examples 22 and 23, Example 7 with Comparative Examples 24 and 25, Example 8 with Comparative Examples 26 and 27, Example 1 with Comparative Examples 28 and 29, and Example 2 with Comparative Examples 30 and 31).

Furthermore, if both of the thermosensitive recording layer and the protective layer respectively comprise ammonium zirconium carbonates as the crosslinking agent, these properties are further improved with a good balance (compare Examples 3, 5, 6, 9, 11 and 12 with Examples 1, 2, 4, 7, 8 and 10).

What is claimed is:

1. A thermosensitive recording medium comprising (a) a support, (b) a thermosensitive recording layer installed on the support, the thermosensitive recording layer comprising a colorless or pale colored electron donating leuco dye and an electron accepting color developing agent, and (c) a protective layer on the thermosensitive recording layer, wherein the thermosensitive recording layer comprises, as the electron accepting color developing agent, (i) a sulfonic acid compound represented by the following formula (formula 1)

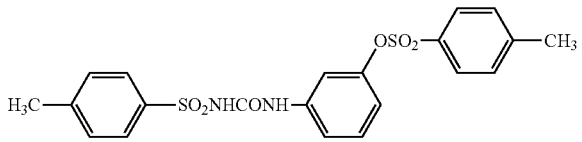

and (ii) a diphenyl sulfone compound represented by the following formula (formula 2)

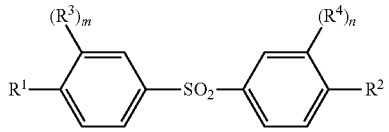

wherein $R^1$ represents a hydroxyl group or a group represented by the following formula (formula 3),

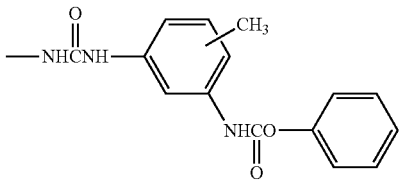

$R^2$ represents $-OR^5$ (wherein $R^5$ represents a linear or branched, saturated or unsaturated hydrocarbon having 1 to 4 carbons) or a group represented by the above formula 3, $R^3$ and $R^4$ each independently represent an alkyl group or an alkenyl group, and m and n each independently represent 0 or 1, wherein both of the thermosensitive recording layer and the protective layer respectively comprise crosslinking agents, and at least one of the thermosensitive recording layer and the protective layer comprises an ammonium zirconium carbonate as the crosslinking agent.

2. The thermosensitive recording medium of claim 1, wherein the diphenyl sulfone compound is represented by the following formula (formula 4)

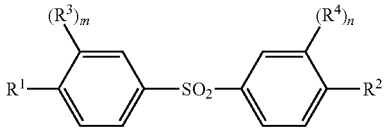

wherein $R^3$, $R^4$, $R^5$, m and n are as defined above.

3. The thermosensitive recording medium of claim 2, wherein the diphenyl sulfone compound is 4-hydroxy-4'-allyloxy-diphenylsulfone.

4. The thermosensitive recording medium of claim 1, wherein the diphenyl sulfone compound is an urea-urethane type diphenyl sulfone compound represented by the following formula (formula 5)

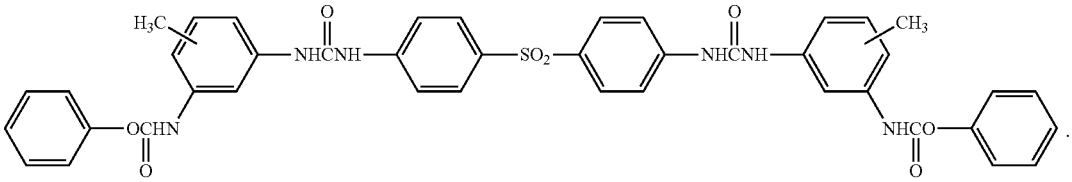

5. The thermosensitive recording medium of claim 1, wherein both of the thermosensitive recording layer and the protective layer respectively comprise ammonium zirconium carbonates as the crosslinking agent.

6. The thermosensitive recording medium of claim 1, wherein the thermosensitive recording layer does not comprise an ammonium zirconium carbonate and comprises a crosslinking agent selected from the group consisting of (1) zirconium compounds other than ammonium zirconium carbonate and (2) polyvalent aldehyde compounds, or wherein the protective layer does not comprise an ammonium zirconium carbonate and comprises a crosslinking agent selected from the group consisting of (1) zirconium compounds other than ammonium zirconium carbonate and (2) polyvalent aldehyde compounds.

7. The thermosensitive recording medium of claim 1, wherein the thermosensitive recording layer comprises an ammonium zirconium carbonate and does not comprise a crosslinking agent other than ammonium zirconium carbonate and/or the protective layer comprises an ammonium zirconium carbonate and does not comprise a crosslinking agent other than ammonium zirconium carbonate.

8. The thermosensitive recording medium of claim 1, wherein the thermosensitive recording layer comprises an ammonium zirconium carbonate and further comprises a crosslinking agent selected from the group consisting of (1) zirconium compounds other than ammonium zirconium carbonate and (2) polyvalent aldehyde compounds and/or the protective layer comprises an ammonium zirconium carbonate and further comprises a crosslinking agent selected from the group consisting of (1) zirconium compounds other than ammonium zirconium carbonate and (2) polyvalent aldehyde compounds.

9. The thermosensitive recording medium of claim 1, wherein the thermosensitive recording layer and the protective layer respectively comprise binders.

10. The thermosensitive recording medium of claim 9, wherein the thermosensitive recording layer comprises polyvinyl alcohols as the binder.

11. The thermosensitive recording medium of claim 9, wherein the protective layer comprises a carboxyl group-containing resin as the binder.

12. The thermosensitive recording medium of claim 11, wherein the carboxyl group-containing resin is an acrylic resin.

protective layer on the thermosensitive recording layer, wherein the thermosensitive recording layer comprises, as the electron accepting color developing agent, (i) a sulfonic acid compound and (ii) a diphenyl sulfone compound, wherein (i) the sulfonic acid compound is represented by the following formula (formula 1)

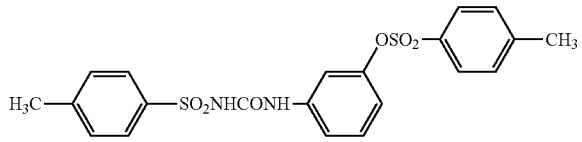

and (ii) the diphenyl sulfone compound is the diphenyl sulfone compound represented by the following formula (formula 4)

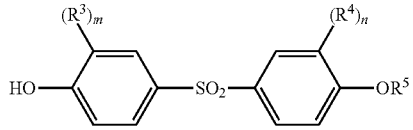

wherein $R^5$ represents a linear or branched, saturated or unsaturated hydrocarbon having 1 to 4 carbons, $R^3$ and $R^4$ each independently represent an alkyl group or an alkenyl group, and m and n each independently represent 0 or 1, or the urea-urethane type diphenyl sulfone compound represented by the following formula (formula 5)

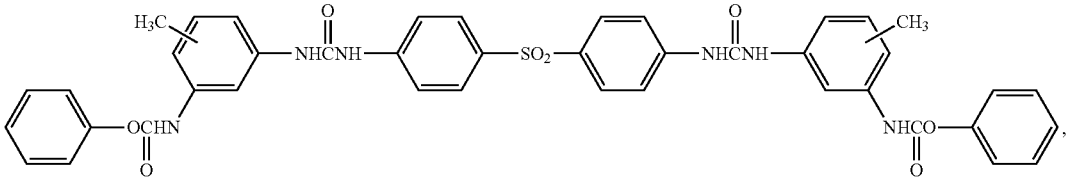

13. The thermosensitive recording medium of claim 11, wherein the carboxyl group-containing resin is a carboxy modified polyvinylalcohol.

14. A thermosensitive recording medium comprising (a) a support, (b) a thermosensitive recording layer installed on the support, the thermosensitive recording layer comprising a colorless or pale colored electron donating leuco dye and an electron accepting color developing agent, and (c) a wherein both of the thermosensitive recording layer and the protective layer respectively comprise crosslinking agents, and at least one of the thermosensitive recording layer and the protective layer comprises an ammonium zirconium carbonate as the crosslinking agent.

* * * * *